United States Patent [19]

Pikus

[11] 4,097,968

[45] Jul. 4, 1978

[54] CLIP

[76] Inventor: Joseph R. Pikus, 71 Central Ave., Lancaster, N.Y. 14086

[21] Appl. No.: 674,412

[22] Filed: Apr. 7, 1976

[51] Int. Cl.[2] ..... A44B 21/00; D06C 3/08

[52] U.S. Cl. ..... 24/73 CC; 38/102.91

[58] Field of Search ..... 38/102–102.91; 24/86 B, 86 R, 85 B, 87 R, 73 B, 146, 243 FS; 69/19; 211/89

[56] References Cited

U.S. PATENT DOCUMENTS

| | | | |
|---|---|---|---|
| 312,637 | 2/1885 | Hopkins | 24/86 R X |
| 605,978 | 6/1898 | Shepherd | 24/87 R X |
| 717,288 | 12/1902 | Schneider | 24/243 FS |
| 2,174,789 | 10/1939 | Kennedy | 38/102.91 |
| 2,704,415 | 3/1955 | Shiffman | 38/102.91 X |
| 3,298,651 | 1/1967 | Passer | 248/217.3 |
| 3,447,823 | 6/1969 | Gregoire | 248/217.3 X |
| 3,841,008 | 10/1974 | Cusick | 38/102.91 |
| 3,942,272 | 3/1976 | Doyell | 38/102.91 |

*Primary Examiner*—Doris L. Troutman

*Attorney, Agent, or Firm*—Howard Alan Taishoff

[57] ABSTRACT

A clip to detachably grip fabric is comprised of a generally planar member. The member is formed with fabric engaging means adapted to grip the fabric. The fabric engaging means is, preferably, in the form of a plurality of sharp prongs that extend from one planar side of the member. The member is formed also with means for coupling a tensional force to the member. When a tensional force is applied or coupled to the member, the prongs are caused to grip the fabric firmly whereby the member becomes securely attached to the fabric.

1 Claim, 7 Drawing Figures

CLIP

This invention relates to a detachable clip that can be used to grip fabric or needle-craft when the fabric is mounted for display or blocked.

In needlecraft such as crewel work and needlepoint a decorative stitch is sewn or embroidered onto a cloth or canvas backing. When artfully done such needlecraft exhibits unique textures and effects. Hence much of this needlework is mounted picture-like for display.

The standard technique for display mounting the needlecraft or needlework is to size a board or stiff backing complementary to the size of the piece to be mounted. The needlecraft is then pulled or stretched over the peripheral edges of the board and the excess material or perimetric border is folded back onto the exposed or rearward board surface. While tension is maintained on this fold-back edge, nails or staples are driven through it permanently to couple this edge to the board. This procedure is a far from ideal solution to the problem of an effective mounting system. Since the supporting and backing board is relatively thin, care must be taken in sizing the nails and staples lest they extend through the board and cut the needlecraft. Furthermore, during this mounting procedure the needlecraft is normally placed face down with the front and display side thereof resting on a hard surface. If the nail-driving or hammering is not skillfully done the needle-craft will mat, or worse, the impact may cause localized deformations and spreading of the embroidered stitching. Then too, care must be taken in selecting the nails or staples to insure that the same do not rust or discolor since the discolorations tend to bleed onto the needlecraft.

To avoid these problems it has been suggested to use pressure sensitive tapes or glues. The drawbacks of these schemes are apparent. In the case of tapes not the least of these drawbacks is the tendency of the tape to loosen, and in the case of glues, it is the permanent nature of this mount and the necessity for holding the edge material while the glue sets.

Besides problems encountered in mounting the finished piece for display, in making the needlecraft the constant handling, bending and stitching of the material acts to distort the workpiece. This is particularly true if a slant or bias stitch is used since the continual slant of the stitching in the same direction tends severely to distort the workpiece. The procedure used to restore the needlecraft to its correct shape is called "blocking." Blocking is usually accomplished by wetting, stretching and then nailing or tacking the cloth grid onto a supporting board by means of a plurality of perimetrically spaced nails. As heretofore practiced this nailing technique was a time-consuming chore and required a multitude of nails individually driven through the cloth grid to prevent localized distortion of the grid and needlework.

Generally the present invention overcomes the above-mentioned problems by providing a clip adapted to detachably grip onto the needlecraft or fabric. The clip comprises a generally planar member that is formed integrally with fabric engaging means and means for coupling a tensional force to the member. Preferably, the fabric engaging means is in the form of a plurality of pointed serrations or sharp prongs that extend from one planar side of the member. In one embodiment and by way of illustration only, the means for coupling a tensional force to the member comprises a finger extending minutely from the plane of the member. When a tensional force is coupled to the member the prongs are caused to grip the fabric firmly. This gripping action securely fastens the member to the fabric. The prongs and hence member readily detach from the fabric when the force tensioning the member is uncoupled or disconnected therefrom.

It is therefore an object of the present invention to provide a clip that readily attaches to fabric wherein the clip is comprised of a substantially flat, planar member allowing same to be used when display-mounting the fabric.

It is another object of the present invention to provide a generally planar clip which can be used when demountably stretching needlecraft on a board wherein the needlecraft or fabric can be stretched without having to drive nails, staples or tacks through the same.

It is a further object of the present invention to provide a clip that can be used in mounting and displaying needlework on a suitable stiff backing wherein the clip is detachably coupled to the needlecraft to allow the needlecraft to be removed from the backing for cleaning and then easily restretched and remounted thereon.

It is a still further object of the present invention to provide a needlecraft clip wherein a plurality of clips can be packaged as a kit and sold inexpensively.

Other objects and features of the present invention will become apparent from the following detailed description considered in connection with the accompanying drawings. It is to be understood however that the drawings are designed for purposes of illustration only and not as a definition of the limits of the invention for which reference should be made to the appending claims.

In the drawings wherein the same reference numeral denotes the same element throughout the several views.

Figure 1:
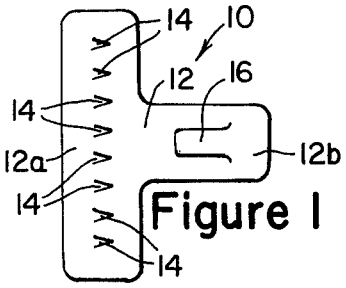
FIG. 1 is a top or plan view of the inventive clip.
Figure 2:
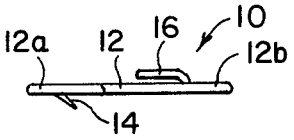
FIG. 2 is a side view of that shown in FIG. 1.

More particularly now and referring to the drawings, FIGS. 1 through 4 show an embodiment of the inventive clip with the same being used for mounting and display of the needlecraft. A clip, generally indicated by reference numeral 10, is defined by a relatively thin planar member 12 formed with a relatively wide or broad leading portion **12*a* and a trailing portion 12*b*. As best seen in FIGS. 1 and 2, the fabric engaging means preferably comprises a plurality of V-grippers or prongs 14 that are integrally formed or carried on portion 12*a*. The tips of V-grippers or prongs 14 angle or slant from the plane of the clip and project toward clip portion 12*b*. It will be apparent that prongs 14 are sufficiently sharp to adequately grip the needlecraft or fabric without danger of injuring same. The means for coupling a tensional force to member 12 is integrally formed on clip portion 12***b*. The coupling means is preferably in the form of a hook or projecting finger 16. In the construction shown and as viewed in FIG. 2, finger 16 extends minutely upwardly and it is seen that the finger is disposed essentially parallel to, albeit spaced from, the opposed or adjacent surface of member 12. Finger 16 is in confronting alignment with prongs 14 and while not mandatory it is preferred that the finger and prongs extend from opposite faces or sides of clip member 12 as shown.

Figure 3:
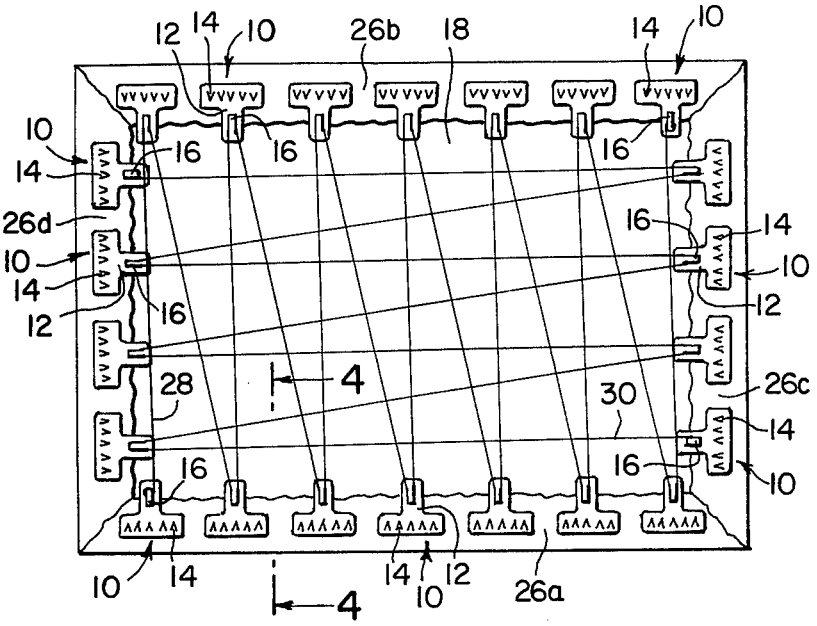
FIG. 3 is a rear view of needlecraft mounted on a board and ready for display, a plurality of clips according to FIGS. 1 and 2 are seen spaced about the fold-back perimetric border of the needlecraft with the clips tensioned and laced by a cord.
Figure 4:
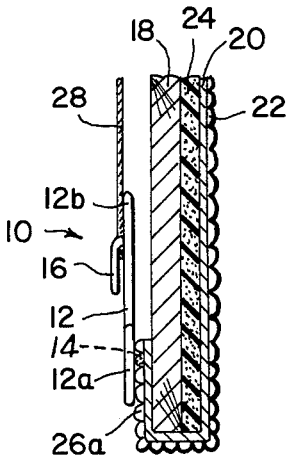
FIG. 4 is a fragmentary sectional view drawn on an enlarged scale taken on line 4—4 of FIG. 3 and looking in the direction of the arrows.

Operation and use of the inventive clip is best understood with reference to FIGS. 3 and 4. A relatively stiff mounting board 18 is sized complementary to, yet somewhat smaller than, the needlecraft that comprises a canvas backing or cloth grid 20 interwoven with stitching 22. As will be described shortly and when display-mounting the needlecraft, it is preferable to use a cushioning layer 24 sized complementary to board 18 and comprised of a suitable resilient material. The needlecraft that includes canvas 20 and embroidery 22 is laid over the board interpositioning layer 24 between board 18 and the non-display side of the needle-work. Perimetric border edges 26*a*, 26*b*, 26*c* and 26*d* of the needlework are folded back over the peripheral edges of board 18 and flattened onto the rearward and exposed surface thereof. Perimetric fold-back edges 26*a*, 26*b*, 26*c* and 26*d* are temporarily tacked to this rearward surface of board 18 by means of pins, the pins not shown.

A plurality of clips 10 are then attached in spaced array along fold-back borders or edges 26*a*, 26*b*, 26*c* and 26*d* by causing prongs 14 of a respective clip lightly to engage and grip the needlecraft stitching. The spacing of the clips is such generally to cover the perimetric fold-back border defined by edges 26*a*, 26*b*, 26*c* and 26*d*.

A first string or card 28 has one end thereof attached or tied to finger 16 of a first selected clip on border 26*a*. It is preferable to choose a corner clip as the one first selected. Cord 28 is then stretched and strung to be received or wrapped partways around coupling means or finger 16 of a confronting clip 10 on opposite perimetric edge 26*b*. The cord is then redirected and stretched in the general direction from where it came to wrap partways around finger 16 of the next available clip on perimetric border 26*a*. As is apparent from FIG. 3 this alternate stringing is repeated pulling tightly on cord 28 as it traverses from clip to clip on opposed perimetric fold-back borders 26*a* and 26*b* until the clips on borders 26*a* and 26*b* are laced tautly. When the last available and unstrung clip is reached, cord 28 is tied to finger 16 thereof.

A second cord 30 is tied to finger 16 of a clip 10 on perimetric border 26*c* again preferably choosing a corner clip. In a manner similar to that described with reference to cord 28, cord 30 is then stretched to be received or caught on finger 16 of a substantially confronting clip 10 on opposed perimetric border 26*d*. Cord 30 is pulled tightly as it stretches from clip to clip on alternate edges 26*c* and 26*d*. And, when the last available clip is reached, cord 30 is tied to finger 16 thereof. The pins used in temporarily tacking border edges 26*a*, 26*b*, 26*c* and 26*d* are now removed.

The means for coupling a tensional force to clip member 12, that, in the embodiment under discussion comprises finger 16, applies or couples the tensional force of an associated cord to a respective clip. More specifically and as an example, as cord 28 is pulled taut, finger 16 couples the tensional force of cord 28 to member 12. With a tensional loading now placed on, or coupled to, a given clip, respective clip prongs 14 are caused to grip firmly onto the needlecraft pulling associated perimetric borders 26*a*, 26*b*, 26*c*, and 26*d*. The pulling of these perimetric borders tensions and stretches the display side of the needlecraft to produce an effective mount. The clips can be easily detached from the needlecraft by merely cutting or unlacing cords 28 and 30. A given clip is then separated from the needlecraft by lifting same to disengage prongs 14 from respective portions on the needlecraft perimetric border.

While the lacing and tensioning of the clips was shown and accomplished by use of two discrete cords 28 and 30 it will be apparent that the lacing and tensioning can be accomplished with a single string. Then too, other lacing schemes are available such as spring loaded or elastic elements, or, rubber bands. Indeed, heat shrinkable elements are also available to provide interconnection and tensioning of the clips.

Figure 5:
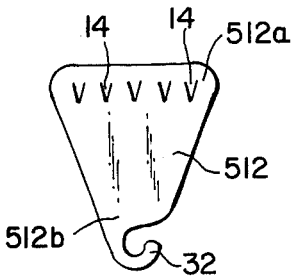
FIG. 5 is a top or plan view of another embodiment of a clip according to the present invention.
Figure 6:
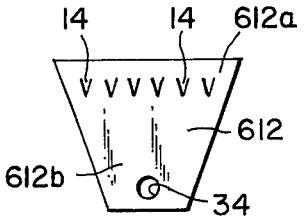
FIG. 6 is a top or plan view of yet another embodiment of a clip according to the present invention; and, FIG. 7 shows another use of an embodiment of the inventive clip, such use being for blocking of the needlecraft and employing the embodiment of FIG. 6.

Referring now to FIGS. 5 and 6 there are respectively shown two modified forms of the inventive clip. In FIG. 5 a clip body 512 has V-grippers or prongs 14 on leading clip body portion 512*a* that are in all respects similar to the prongs discussed with reference to FIGS. 1 through 4. In the embodiment of FIG. 5 the means for coupling a tensional force to clip body 512 comprises a hook 32 that is formed on, and integral with, trailing clip portion 512*b*. Operation or use of the clip shown in FIG. 5 is essentially similar to that described with reference to FIGS. 1 through 4 although it is apparent that cords 28 and 30, as the case may be, are directed to catch on a respective hook 32 as clip bodies 512 are laced and the needlecraft tensioned.

In FIG. 6 a clip body 612 has prongs 14 on leading clip body portion 612*a*. These prongs are in all respects similar to the V-grippers or prongs discussed with reference to FIGS. 1 through 4. In the embodiment of FIG. 6 an aperture 34 comprises the means for coupling a tensional force to clip body 612, and, as shown, this coupling means is formed on trailing clip portion 612*b*. Operation or use of the clip of FIG. 6 is substantially similar to that described with reference to FIGS. 1 through 4. However, cords 28 and 30, as the case may be, are received in and directed through a respective aperture 34 as the clips are laced and the needlecraft tensioned.

Figure 7:
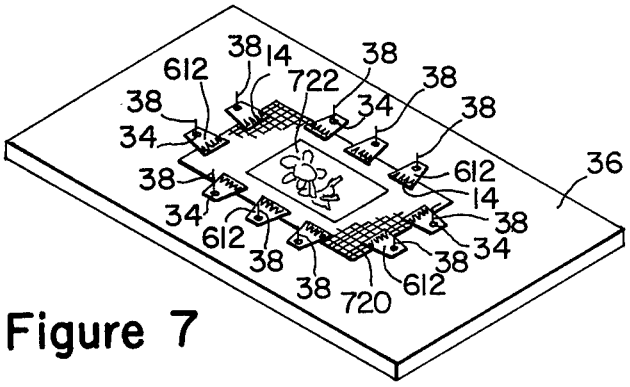

In addition to using the inventive clip for mounting the needlework when displaying same, other uses of the inventive clip readily suggest themselves. One such other use is in "blocking" or squaring of the needlework. Thus turning to FIG. 7 there is shown one embodiment of the inventive clip used for this blocking. A flat board 36 is sized larger than the needlecraft with the needlecraft consisting of canvas or cloth grid 720 carrying embroidery 722. Grid 720 and embroidery 722 are dampened and placed on blocking board 36. Before placing the needlework on the board, it is preferable to interpose a fabric piece, the piece not shown, between the board and needlework to isolate them. Clips 612 are spaced about the perimetric border of the exposed canvas or cloth grid so as generally to cover the same and in such manner as to cause prongs 14 of a respective clip to engage the associated interstices of grid 720. As this is done the clips, severally or in combination, are pulled from the needlework center until that portion of the grid reacting against a given clip is taut. A nail or tack 38 is then driven into a respective aperture 34 of a given clip 612 demountably affixing and tensioning same on board 36. Tensioning the clips tensions and stresses fabric grid 720 to stretch and eventually restore the needlework to its proper shape. After the needlework is dry and blocked it is removed easily by withdrawing nails 38 from their associated apertures and dislodging or detaching prongs 14 of a respective clip from engagement in the canvas grid.

Preferably the several embodiments of the clips are stamped from metallic and non-rusting sheet stock. In addition, there is a wide range of materials from which the clips can be made. For example, the clips can be made of plastic, nylon or teflon, or a composite thereof such as a clip having metallic prongs and a metallic finger part with these metallic elements carried on a plastic member or body part.

While only a few embodiments of the present invention have been shown and described it is to be understood that many changes and modifications can be made hereto without departing from the spirit and scope hereof.

What is claimed is:

1. A clip to detachably grip fabric comprising a generally planar member, said member being defined, in plan view, by a broad leading portion and a relatively narrow trailing portion, said broad leading portion having a forward edge and a rearward edge, a plurality of pointed prongs integrally formed on said member and adapted to engage the fabric, said pointed prongs being positioned on said broad leading portion spaced from said forward and rearward edges thereof and extending from one planar side of said member, said pointed prongs being disposed in canted configuration so as to angle in a direction generally towards said trailing portion, a finger integrally formed on said trailing portion and extending minutely from the other planar side of said member, said finger being defined by a bend part rising minutely upwardly from the plane of said member and an elongated part having one end integral with said bend part and the other end oriented so as generally to point towards said broad leading portion, said bend part being disposed on said trailing portion spaced from said pointed prongs, said elongated part being disposed parallel opposed over, yet spaced from, said other planar side of said member, said finger being adapted to couple a tensional force to said member such that when the tensional force is coupled to said member, said pointed prongs securely grip the fabric whereby said member becomes firmly attached to the fabric.

* * * * *